US005642529A

United States Patent [19]

Fujima

[11] Patent Number: 5,642,529

[45] Date of Patent: Jul. 1, 1997

[54] DIVING FACE MASK

[75] Inventor: Taro Fujima, Higashi-Murayama, Japan

[73] Assignee: Tabata Co., Ltd., Tokyo, Japan

[21] Appl. No.: 535,861

[22] Filed: Sep. 28, 1995

[30] Foreign Application Priority Data

Oct. 7, 1994 [JP] Japan ..... 6-244191

[51] Int. Cl.[6] ..... A61F 9/02

[52] U.S. Cl. ..... 2/428; 128/200.29

[58] Field of Search ..... 2/428, 429, 430, 2/441, 443; 128/200.29, 201.23, 201.28

[56] References Cited

U.S. PATENT DOCUMENTS 3,710,393 1/1973 Douglas ..... 2/430
4,467,797 8/1984 Franke ..... 128/200.29 X
4,856,120 8/1989 Hart .
5,479,917 1/1996 Hsieh ..... 128/200.29

FOREIGN PATENT DOCUMENTS 49-148700 12/1974 Japan .

*Primary Examiner*—Peter Nerbun
*Attorney, Agent, or Firm*—Lowe, Price, LeBlanc & Becker

[57] ABSTRACT

A diving face mask comprising a purge valve is mounted in a predetermined region extending along a top and transversely opposite sides of a frame thereof and a tubular water purge channel provided inside said frame, said purge channel having an outlet at its upper end being in fluid-communication with said purge valve and an inlet at its lower end being open into said frame.

9 Claims, 10 Drawing Sheets

DIVING FACE MASK

BACKGROUND OF THE INVENTION

The present invention relates to a diving face mask a diver puts on his or her face during diving such as skindiving or scuba-diving, and more particularly to such a diving face mask provided with a purge valve through which a quantity of water accumulating within the mask is purged together with exhalation through the nose of the diver out of the mask.

Conventional diving face masks provided with a purge valve generally characterized by a cylindrical or square tubular section extending forwards from the central zone of a mask's front side to form a valve chamber in which the valve is mounted. For example, Japanese Utility Model Application Laid-Open No. 1974-148700 and U.S. Pat. No. 4,856,120 disclose a single-lens diving face masks provided with a purge valves. These masks of prior art include behind a purge valve, a valve chamber and nose pinching portions formed by partially recessing a main frame of the mask on both sides of the chamber.

Such masks of prior art as have been mentioned above are inconvenient in that a valve chamber extending forwards may obstruct wearer's sight. For example, when a wearer turns his or her eyes obliquely downwards, the valve chamber obstructs his or her sight. With an arrangement that a mask is provided with nose pinching portions immediately behind the valve, the valve and the valve chamber obstruct an easy operation for nose pinching. In other words, the presence of the valve chamber makes it difficult to assure a space allowing the nose pinching portions to be large enough to be easily operated. In spite of these problems, there is a serious demand from many of divers that a two-lens mask also could be provided with such a purge valve in view of significantly advantageous effect the purge valve should present. Nevertheless, no technique available for such a demand has been developed.

Accordingly, it is a principal object of the invention to solve such technical problems as mentioned above and thereby to meet the demand from divers by providing a purge valve at a predetermined location in a zone extending from a top to transversely opposite sides of a main frame of a mask and tubular water purge channels inside the main frame so that the purge valve fluid-communicate with water purge channels.

SUMMARY OF THE INVENTION

To achieve the object set forth above, the invention broadly resides in a diving face mask comprising a main frame equipped with a lens frame having a top, transversely opposite sides curving downwards respectively from the transversely opposite ends of said top, a bottom being continuous with said opposite sides and opposed to said top, and a lens holding portion, and a tubular skirt extending rearwards from said lens holding portion; at least a front lens held by said lens holding portion; a strap connected to both sides of said main frame used to maintain the mask on a wearer's face; and a purge valve mounted on said main frame and adapted to be opened outwards; wherein said purge valve is provided at an predetermined location in a zone defined along said top and said transversely opposite sides of said main frame, and a tubular water purge channel is provided along the inner periphery of said main frame inside said front lens, said tubular water purge channel having an outlet at one end being in fluid-communication with said purge valve and an inlet at the other end opening into the interior of said main frame at the bottom of said main frame.

According to one embodiment of the invention, said mask further comprises a pair of lenses and a nose covering portion interposed between said lenses. Said valve may be provided at a transversely middle point along said top and there may be provided said water purge channel in association with each of said lenses in fluid-communication with said valve. There may be provided inside said nose covering portion a vertically extending tubular water purge channel with an outlet at its upper end being in fluid-communication with said valve from the inside and an inlet at its lower end opening into the interior of said mask at the bottom of said nose covering portion. According to this embodiment, said valve and water purge channel may be provided in association with each of said lenses and these valve and water purge channel may be in fluid-communication with each other for each of said lenses. There may be also provided at a transversely middle point along said top a purge valve adapted to be opened outwards and there may be provided a vertically extending tubular water purge channel with an outlet at its upper end being in fluid-communication with said valve from the inside and an inlet at its lower end opening into the interior of said mask at the bottom of said nose covering portion.

According to a variant of the invention, said mask comprises a single front lens. With such a mask, said valve may be provided at a transversely middle point along said top and said water purge channel may be provided along one of transversely opposite sides of said single lens, with an outlet at its upper end being in fluid-communication with said valve from the inside of said main frame and an inlet at its lower end opening into the interior of said mask at a middle point along the bottom of said main frame. Said valve may be also provided in said top at a location adjacent each of transversely opposite ends thereof and said water purge channel may be provided along each of said transversely opposite sides of said single-lens with an outlet at its upper end being in fluid-communication with said valve provided on the same side as said outlet and an inlet at its lower end opening into the interior of said mask on the same as said valve at the bottom of said main frame.

With the diving face mask of the above-mentioned arrangement, a quantity of water accumulating within the main frame can be purged together with exhalation out of the valve via the water purge channel. Since the valve is provided at a predetermined location in a zone extending from the top to the transversely opposite sides of the main frame, the mask does not need a conventional valve chamber extending forwards from a front side of a mask. Therefore, the presence of the valve does not obstruct wearer's sight.

Such an arrangement according to the invention allows the valve to be mounted in the mask without obstructing the desired function of the mask even in the case of two-lens mask.

PREFERRED EMBODIMENTS OF THE INVENTION

Figure 1:
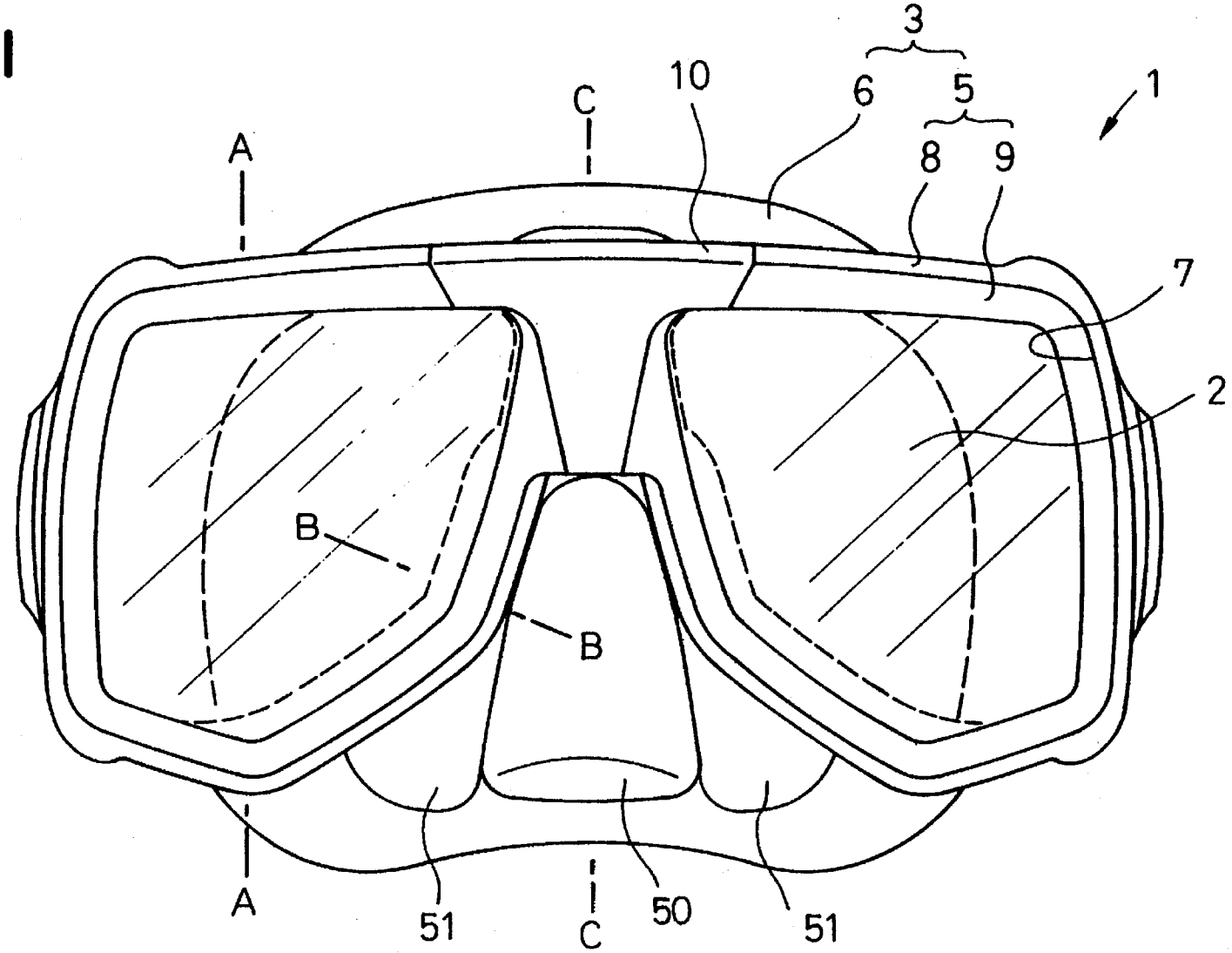
FIG. 1 is a front view showing an embodiment of a diving face mask according to the invention.

Referring to FIGS. 1 through 6, a mask 1 is transversely symmetric and comprises a pair of front lenses 2, a main frame 3 having a front portion adapted to be engaged with the lenses 2 and a rear section adapted to be tightly put over a wearer's face, and a strap 4 attached to the main frame 3 so as to be releasably fastened around the wearer's head.

The lenses 2 are made of plastics on glass and detachably mounted in water-tight condition on the main frame 3 from the front thereof.

The main frame 3 comprises a lens frame 5 of hard plastics and a cylindrical skirt 6 of soft rubber or plastics. The lens frame 5 comprises an outer peripheral frame 8 having a pair of transversely symmetric lens holding portions 7, a pair of transversely symmetric inner peripheral frames 9 adapted to snap around the lens holding portions 7 provided with the lenses 2 from the front in order to protect the lenses 2 against slipping off from the outer peripheral frame 8, and a frame holding member 10 detachably mounted on a central part of the outer peripheral frame 8 so as to protect the inner peripheral frame 9 against slipping off from the outer peripheral frame 8.

Figure 2:
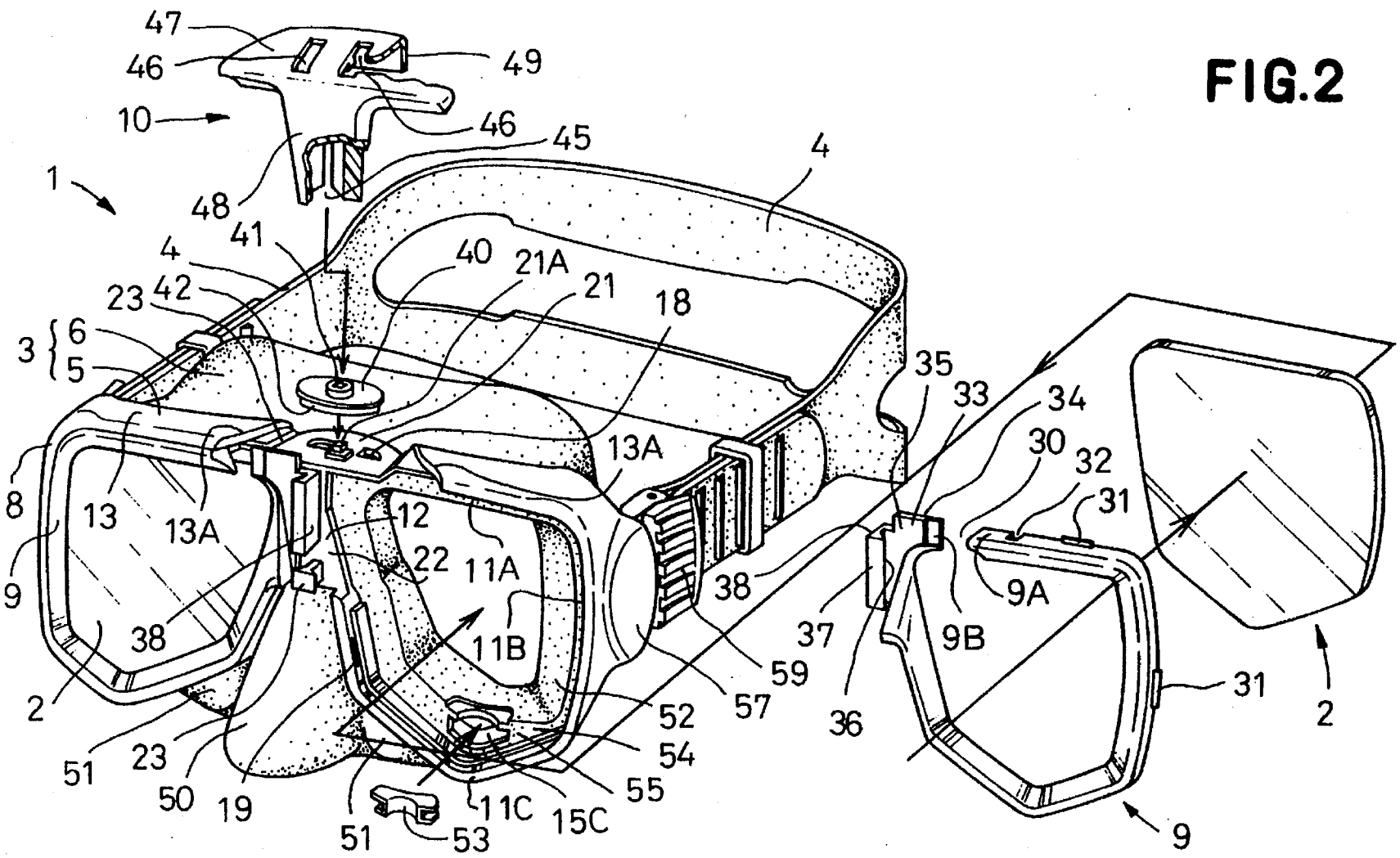
FIG. 2 is a perspective view of the mask shown by FIG. 1 as partially exploded.
Figure 3:
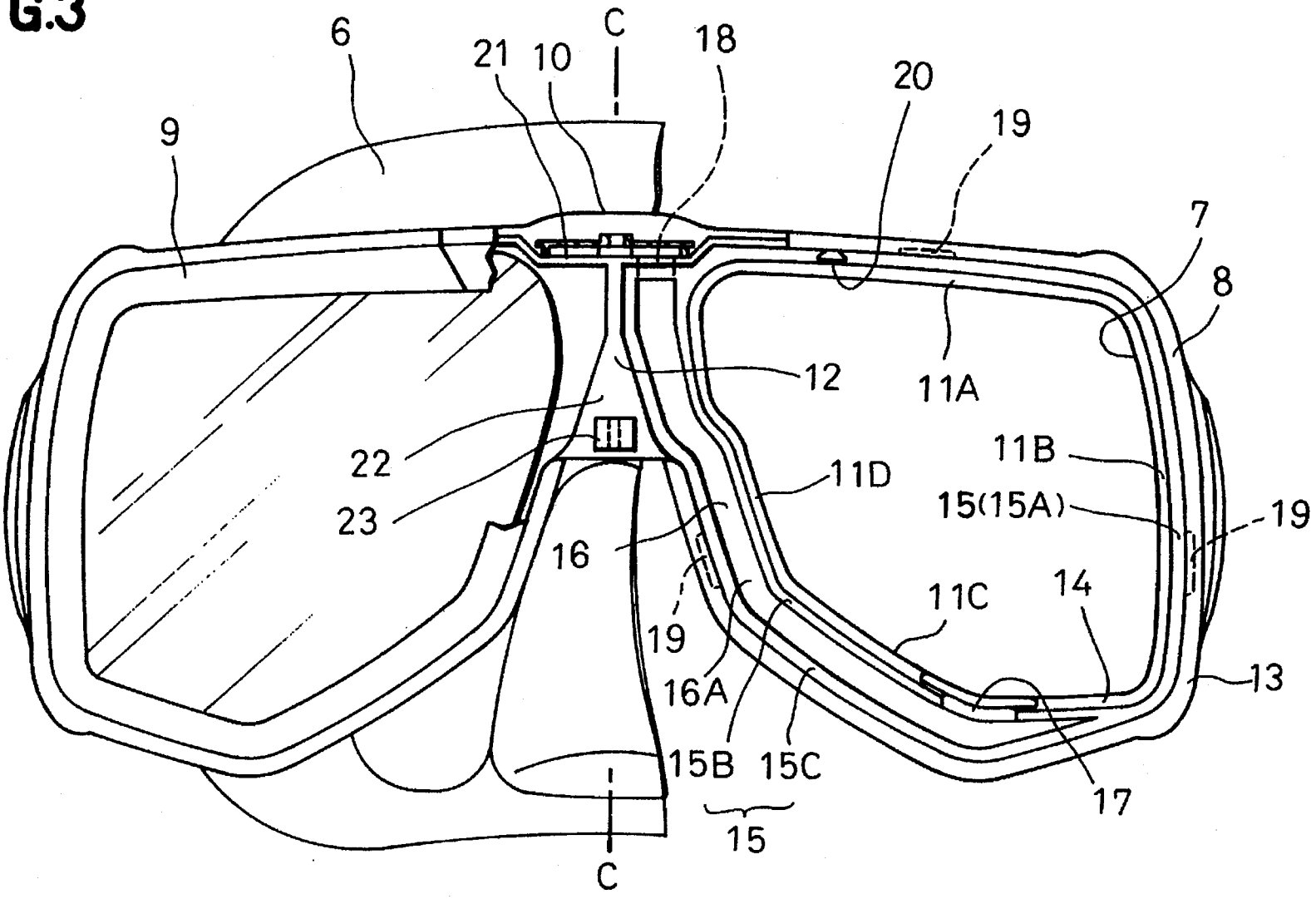
FIG. 3 is a front view similar to FIG. 1 but as partially broken away.

The outer peripheral frame 8 comprises, as will be best seen in FIGS. 2 and 3, a central connector portion 12 interposed between the right- and left-hand holding portions 7, peripheral walls 13 defining each holding portion 7 and extending in front and in rear of the mask 1, and inner flange portions 14 inwardly extending from the inner peripheral surfaces of the peripheral walls 13 along lines defined adjacent the front ends thereof. The respective flange portions 14 are provided on their front surfaces with annular ribs 15 against which front edges of the skirt 6 are pressed. Each rib 15 comprises a single rib 15A extending along a top 11A and a lateral side lib of the outer peripheral frame 8 and a pair of ribs 15B, 15C branched from the rib 15A and extending in parallel along a bottom 11C and an inner side lid of the outer peripheral frame 8. The flange portion 14 has its recessed front surface 16A between the ribs 15B and 15C so as to define together with the ribs 15B and 15C a drainage groove 16. The groove 16 has its lower end communicating with the interior of the main frame 3 through a first opening 17 formed by partially cutting away the rib 15B along the bottom 11C of the outer peripheral frame 8, and its upper end communicating with a second opening 18 extending through the connector portion 12 to the exterior of the mask 1 as will be described later. The inner surface of each peripheral wall 13 is provided, at desired locations more adjacent to the front end thereof than the flange section 14 is, with concave engaging portions 19 and a tenon 20 extending forwardly of the mask 1, through which the inner peripheral frame 9 can be engaged with the peripheral wall 13.

The central connector portion 12 of the outer peripheral frame 8 comprises a substantially horizontal top side 21 located at the level of the top 11A and rearwardly arching, and a substantially vertical, smooth, inverted V-shaped front side 22 extending downwards. The top side 21 is centrally provided with a rectangular boss 21A which is, in turn, provided on either side thereof with a pair of second openings 18 fluid-communicating with the right- and left-hand grooves 16, respectively. A transversely long elliptical purge valve 40 centrally formed with a rectangular through-hole 41 substantially corresponding in its size to the boss 21A is engaged on the boss 21A so that the purge valve 40 covers the second openings 18 with a peripheral wall 42 extending downwards being tightly in contact with the top side 21. Transversely opposite side edges of the top side 21 are configured in conformity with the corresponding side edges of the frame holding member 10 and located at a level lower than the peripheral wall 13 so that the frame holding member 10 is situated so as to form a smooth surface continuous with the peripheral wall 13 when the frame holding member 10 is mounted on the outer peripheral frame 8. A tenon 23 vertically extending along the center line C—C of the mask 1 extends forwards from the lower half of the front side 22 and this lower half is continuous with each peripheral wall 13. The front side 22 is located rewardly of the front end of the peripheral walls 13 so that the frame holding member 10 is situated so as to form a smooth surface continuous with the peripheral wall 13 when the frame holding member 10 is mounted on the outer peripheral frame 8.

As will be best seen in FIG. 2, each inner peripheral frame 9 is substantially annular and has a cut-away section 30 extending circumferentially of the annulus. Circumferentially opposite first and second end portions 9A, 9B defining the cut-away section 30 therebetween are elastically deformable inwardly of the annulus, i.e., in the direction such that the inner peripheral frame 9 has its diameter reduced thereby. The outer peripheral surface of the inner peripheral frame 9 is provided with convex engaging portions 31 and a mortise 32 corresponding to the concave engaging portions 19 and the tenon 20, respectively, of the outer peripheral frame 8. The mortise 32 and the tenon 20 are to be engaged with each other to prevent the inner peripheral frame 9 from being inwardly deformed towards the lens holding portion 7, and they are preferably located adjacent the cut-away section 30. From the outer peripheral surface of the inner peripheral frame 9 adjacent the center line C—C, a lock tongue 33 extends to the center line C—C. The lock tongue 33 has a smooth rear surface 34 destined to bear against the front side 22 of the connector portion 12. The lock tongue 33 is provided in its front surface 35 with a tenon half 37 comprising a longitudinal projection configured to define a groove 36 presenting a V-shaped cross-section extending in parallel to the center line C—C. When the right- and left-hand inner peripheral frames 9 are engaged with the respective lens holding sections 7, side walls 38 of the respective right- and left-hand tenon halves 37 abut against each other along the center line C—C, thereby forming a tenon 39 (see FIG. 6) which presents the same cross-section as that of the tenon 23 on the central connector portion 12 and is vertically aligned with the tenon 23 (on the center line C—C).

Figure 7:
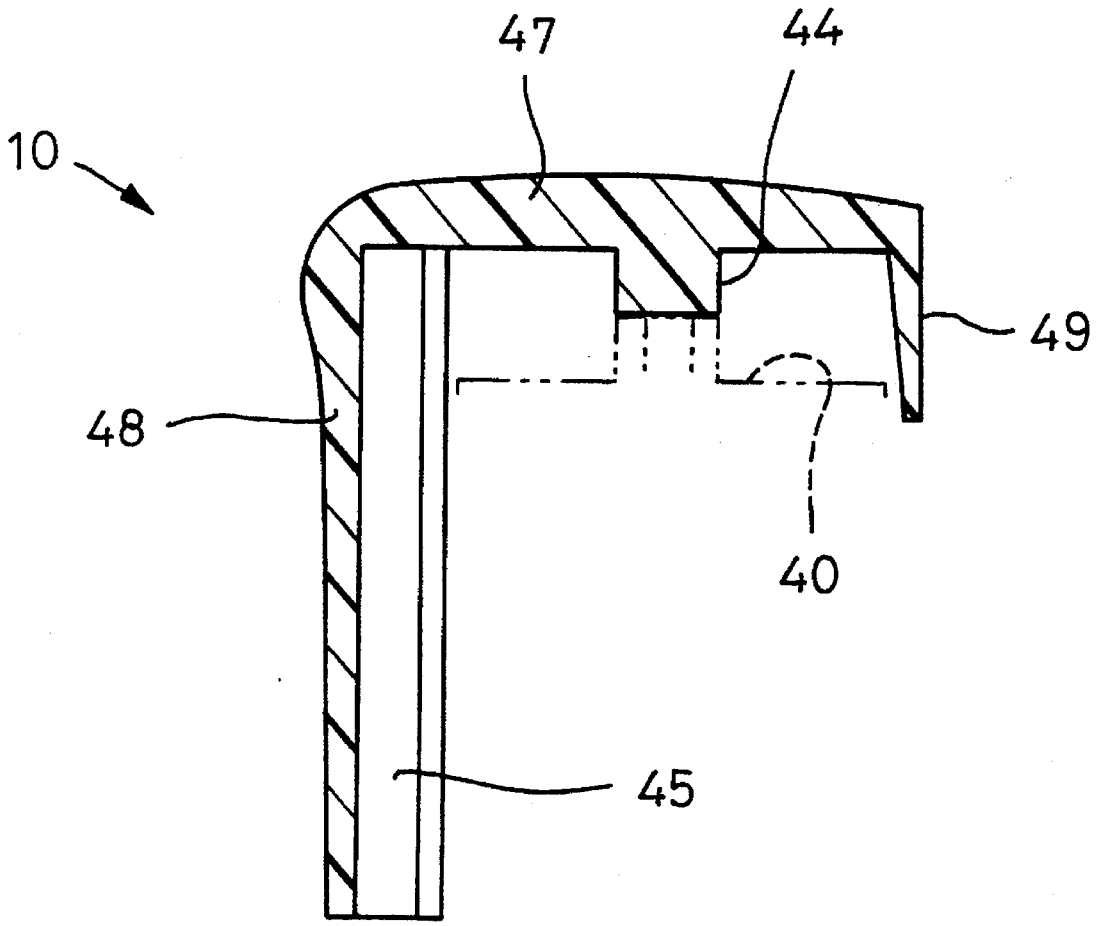
FIG. 7 is a sectional view of a frame holding member along its center line.

FIG. 7 is a sectional view of the frame holding member 10 taken along the center line C—C. Referring to FIGS. 2 and 7, the frame holding member 10 comprises a top portion 47, a front portion 48 and a rear portion 49. The top portion 47 lies between the opposite top side edges 13A of the right- and left-hand peripheral walls 13 of the outer peripheral frame 8, and covers the top side 21 of the central connector portion 12 so as to protect the purge valve 40 from possible contact with foreign substances. A boss 44 extends downwardly from the inner surface of the top portion 47 towards the boss 21A of the top side 21 and bears against the purge valve 40 from above to prevent the purge valve 40 from slipping off from the boss 21A. There are provided a pair of through-holes 46 on either side of the boss 44 to assure air- and water-communication between interior and exterior of the frame holding member 10. The front portion 48 presents a T-like shape as viewed from the front (see FIG. 1) and can completely cover the front side 22 of the central connector portion 12. A mortise 45 vertically extends in the inner surface of the front portion 48 so that the mortise 45 may be slidably engaged with the tenons 23, 39 along the center line C—C to attach or detach the frame holding member 10 to the central connector portion 12. The rear portion 49 of the member 10 really comprises a low wall extending in opposite directions from the center of the frame holding member 10, of which the inner surface is configured substantially in conformity with the rear wall of the top side 21 of the frame 8. The front portion 48 and the rear portion 49 hold therebetween both the top side 21 and the lock tongues 33 of the respective inner peripheral frames 9 from front and rear of the mask 1.

Figure 4:
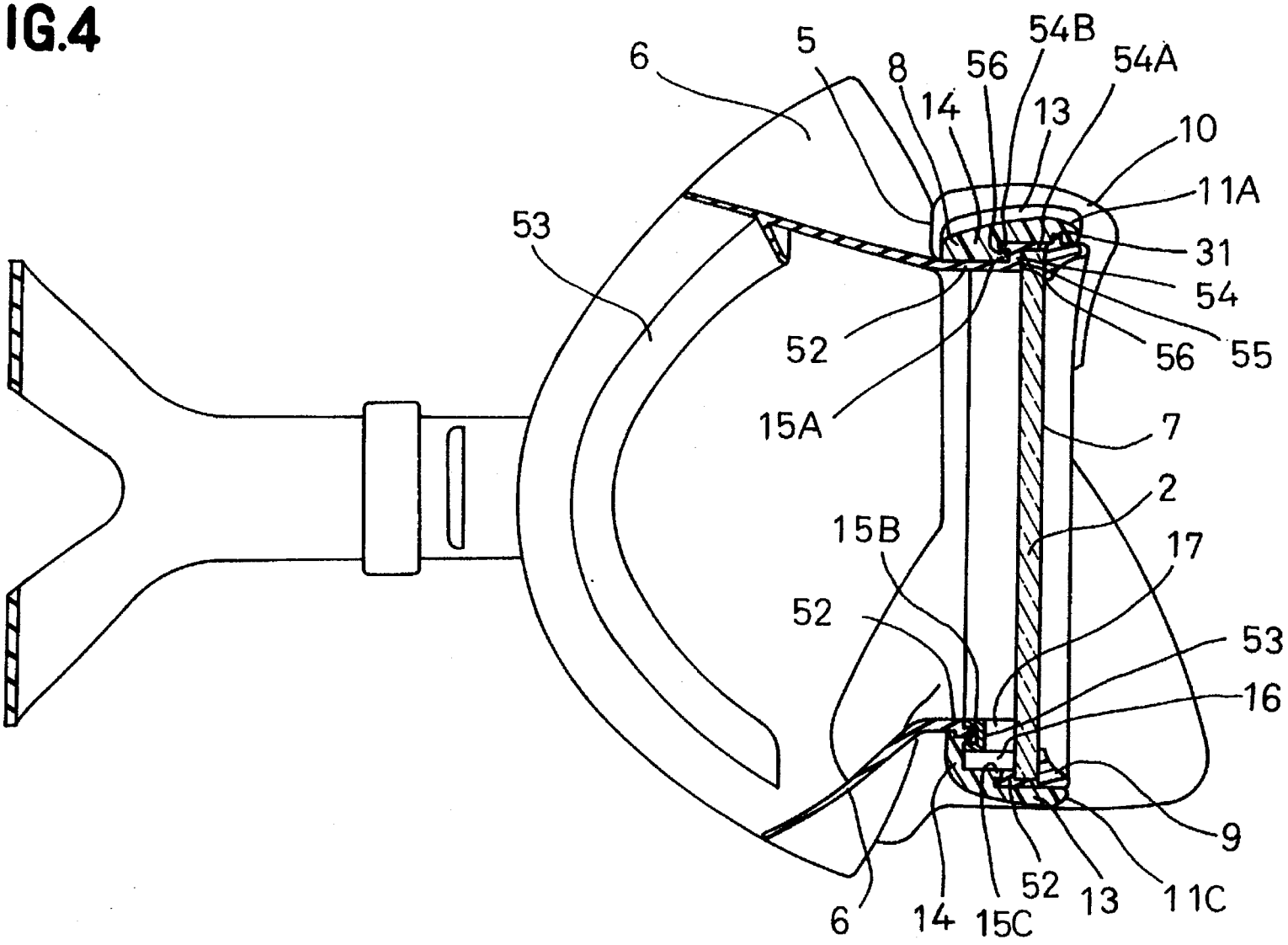
FIG. 4 is a sectional view taken along a line A—A in FIG. 1.
Figure 5:
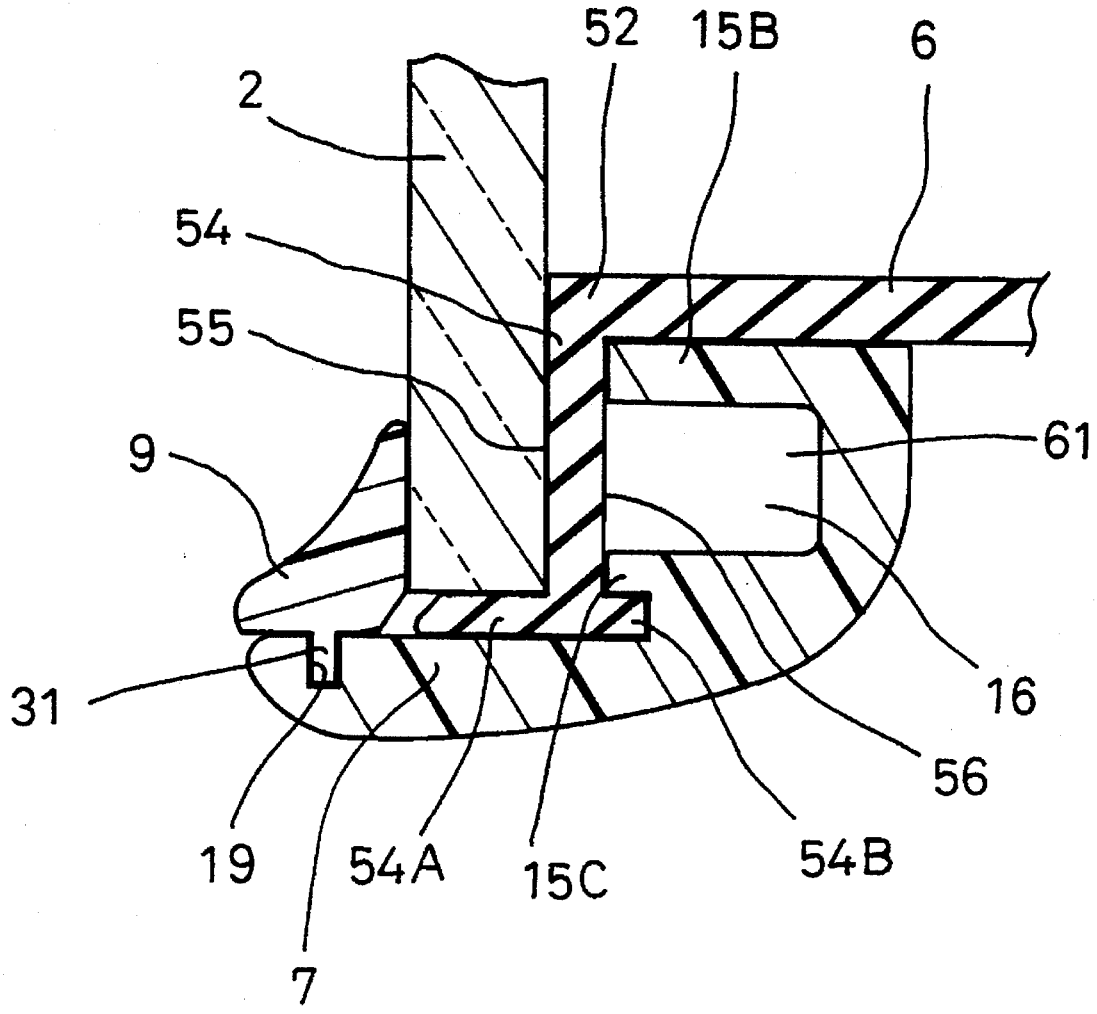
FIG. 5 is a sectional view taken along a line B—B in FIG. 1.
Figure 6:
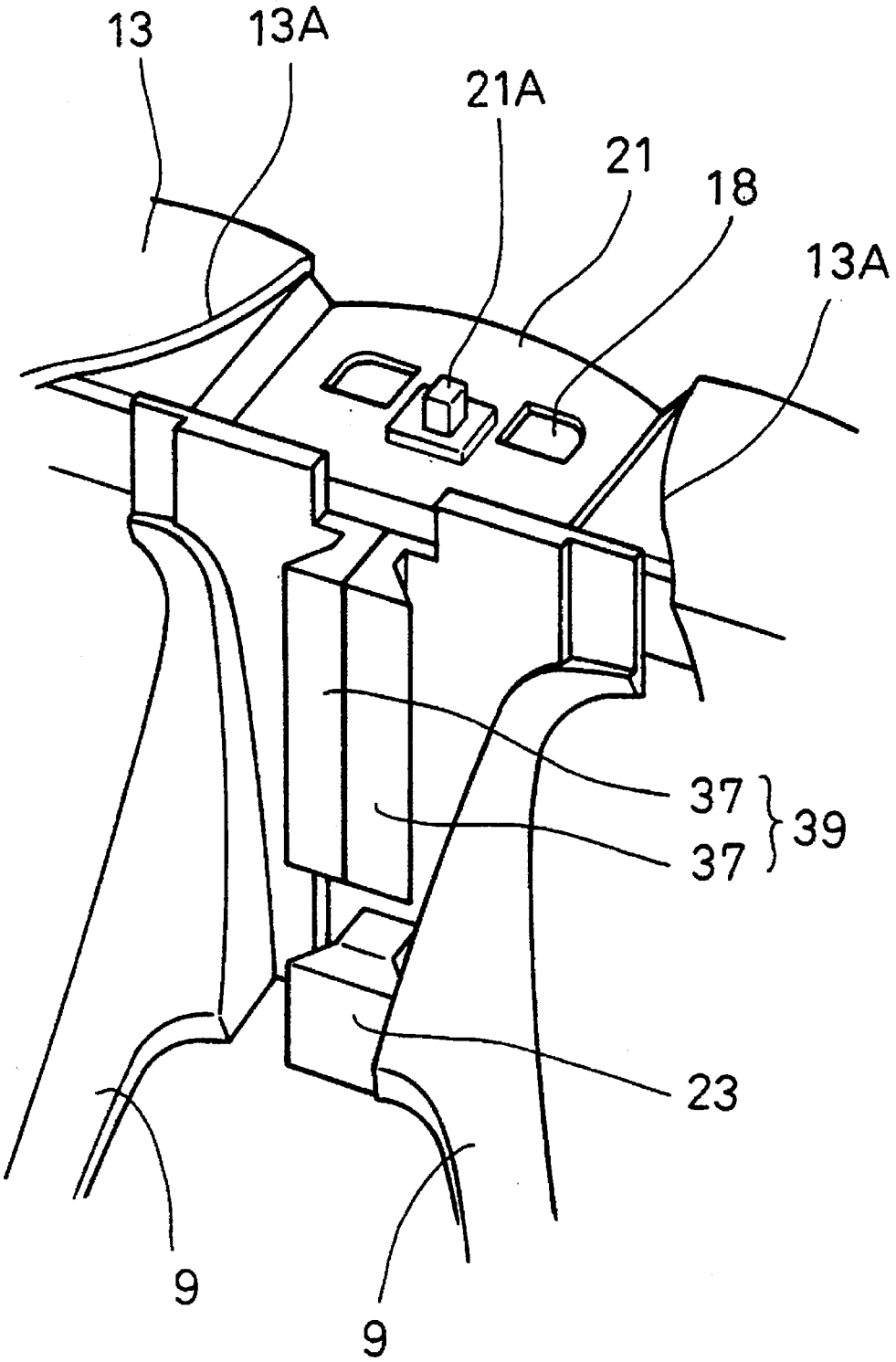
FIG. 6 is a perspective view showing, in an enlarged scale, a part of the mask shown by FIG. 1.

Referring to FIGS. 2, 4 and 5, the skirt 6 includes a nose covering portion 50 centrally extending forwards so as to cover a wearer's nose and, on either side of this nose covering portion 50, the skirt 6 has a pair of nose pinching portions 51 adapted to receive wearer's fingers inserted thereto, and a pair of annular sealing portions 52 serving to maintain water-tightness between each lens 2 and the main frame 5. As shown in details by FIGS. 4 and 5, each sealing portion 52 has a flange-like portion 54 on its front end, of which the front surface 55 bears against the rear side of the lens 2 and the rear surface 56 bears against ribs 15A through 15C of the outer peripheral frame 8. Accordingly, a water-tightness is established between each lens 2 and the ribs 15A through 15C by a cushioning effect of the flange-like portion 54 when the inner peripheral frame 9 is snapped into the outer peripheral frame 8. However, each sealing portion 52 is partially cut away along a region corresponding to the first opening 17 of the outer peripheral frame 8 so that the groove 16 communicates with the interior of the main frame 3, more specifically with a space behind the lens 2 through the first opening 17 even after the skirt 6 has been mounted on the lens frame 5. It should be understood that, even in the region of the first opening 17 corresponding to the cut-away section of the rib 15B along which the rib 15B stays away from the rear surface of the lens 2, the water-tightness is assured by means of a nipper member 53 adapted to nip the sealing portion 52 and the rib 15B put one on another from above and below. The flange-like portion 54 of the skirt 6 bears against the rib 15A along the top 11A and an outer peripheral edge portion 54A of the flange-like portion 54 is interposed as a cushioning means between the inner peripheral surface of the lens holding portion 7 and the outer peripheral surface of the lens 2. Another outer peripheral edge portion 54B of the flange-like portion 54 is interposed between the inner peripheral surface of the lens holding portion 7 and the rib 15A as well as between said inner peripheral surface and the rib 15C to prevent the flange-like portion 54 from shifting inwards radially of the lens holding section 7. The inner peripheral frame 9 snaps into the outer peripheral frame 8 through engagement of the convex engaging portion 31, and at the same time urges the lens 2 rearwards.

As will be best seen in FIG. 5, the flange-like portion 54 of the skirt 6 tightly bears against the ribs 15B, 15C and thereby defines together with the groove 16 a tubular water purge channel 61 presenting a rectangular cross section. This tubular water purge channel 61 extends upwards along the ribs 15B, 15C with an outlet at its upper end fluid-communicating with the second opening 18 extending through the top side 21 of the connector portion 12, and with the first opening 17 at its lower end functioning as an inlet (see FIG. 3).

There are provided a vertical shaft (not shown and a strap adjuster 59 on either side of the outer peripheral frame 8, respectively, for effectively fastening the strap 4 around a wearer's head.

Procedure to assemble the mask 1 of the arrangement as has been described above will be readily understood from the following description made in reference with FIG. 2. The procedure is started by inserting the sealing portion 52 of the skirt 6 into the lens holding portion 7 from behind the lens frame 5 with the rear surface of each front flange-like portion 54 being brought in close contact with the ribs 15A, 15B, 15C, and then the sealing portion 52 and the rib 15B are nipped by the member 53. Now each lens 2 is fixed into the lens holding portion 7 from the front of the mask 1, and successively each inner peripheral frame 9 is snapped into the outer peripheral frame 8 from the front. After the purge valve 40 has been mounted on the boss 21A, the mortise 45 of the frame holding member 10 is successively engaged on the tenons 39, 23 so that the top side 21 of the central connector portion 12 as well as the lock tongue 33 of each inner peripheral frame 9 may be securely held between the front and rear portions 48, 49 of the frame holding member 10. When it is desired to disassemble the mask 1 for exchange of the lens 2 or cleaning of the groove 16, the procedure for assembling may be inversely followed. It should be understood that, in order to take the lens 2 off, the first end 9A of each inner peripheral frame 9 may be moved forwardly of the mask 1 so as to be disengaged from the tenon 20, and then the first end 9A and/or the second end 9B may be elastically deformed inwards radially of the inner peripheral frame 9, i.e., in the direction such that the inner peripheral frame 9 has its diameter reduced thereby. In this manner, the inner peripheral frame 9 can be easily unsnapped without use of any special tools.

With this embodiment of the mask 1 being worn by a wearer, exhalation through the wearer's nose increases a pressure within the mask 1 and thereby drives a quantity of water accumulating within the mask 1 together with the exhalation to enter the first opening 17 serving as the inlet, then flow along the tubular water purge channel 61, forcibly open the purge valve 40 provided at the second opening 18 and exit the mask 1.

Figure 8:
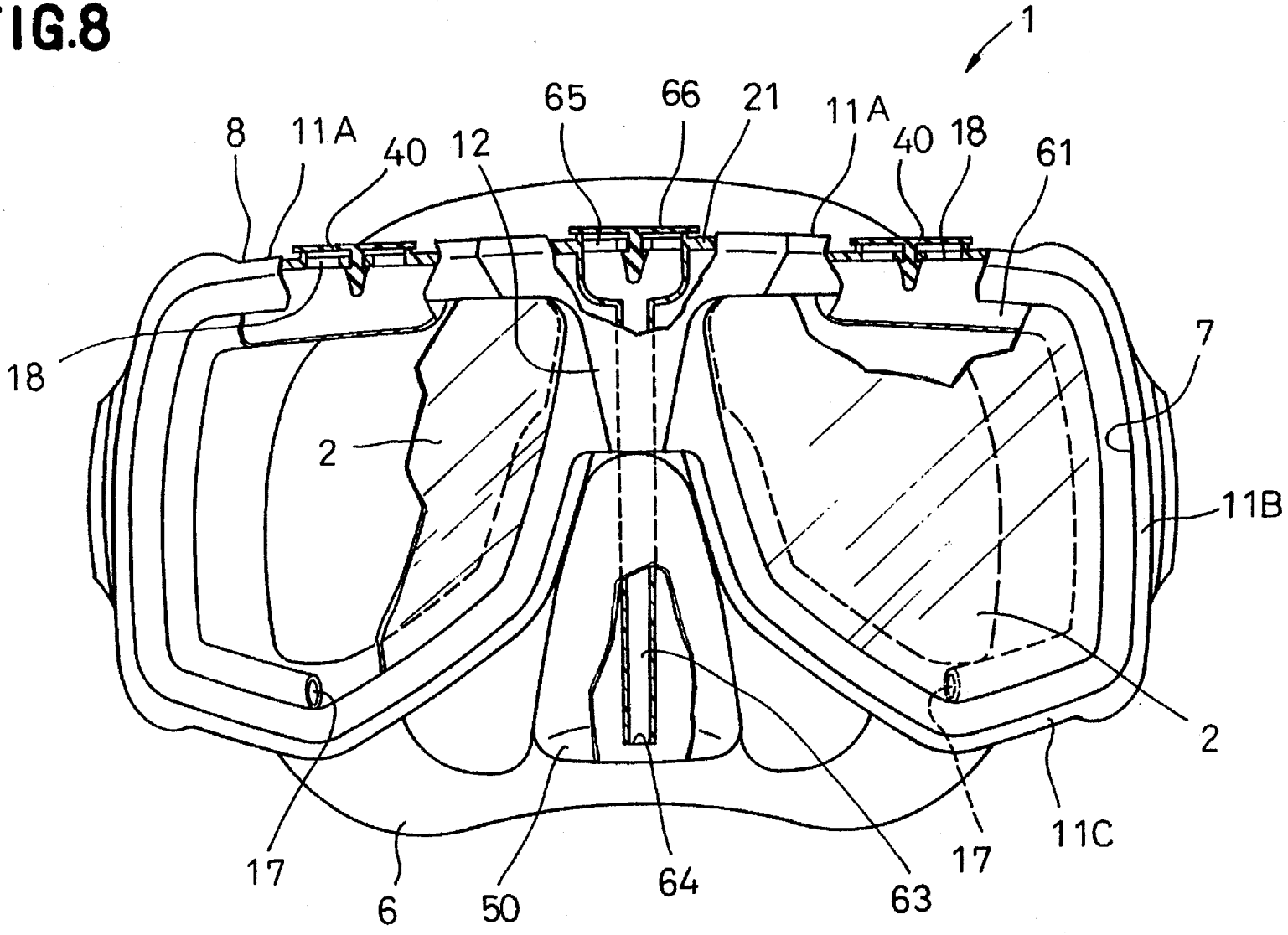
FIG. 8 is a front view showing a variant of the mask as partially broken away.

FIG. 8 is a front view showing a variant of the mask 1 as partially broken away. According to this variant, the outer peripheral frame 8 is provided, in the top 11A associated with each lens 2, with the second opening 18 and the purge valve 40, and the tubular water purge channel 61 having its upper outlet in fluid-communication with the associated second opening 18 extends along the inner periphery of the outer side lib to the bottom **11*c* of the outer peripheral frame 8. The first opening 17 provided at the lower end of the associated water purge channel 61 serving as an inlet is located inside the associated lens 2 and opens into the interior of the main frame 3. Each water purge channel 61 may be molded integrally with the skirt 6 or formed by a pipe made of rubber or soft plastic independently of the skirt 6. According to this specific variant, there is additionally provided a second water purge channel 63 vertically extending inside the nose covering portion 50 with its lower end serving as an inlet 64 opening into a space inside the bottom of the nose covering section 50 and with its upper end serving as an outlet being in fluid-communication with openings 65 extending through the top side 21 of the central connector portion 12 to the exterior of the mask 1. The openings 65 are provided with a purge valve 66 adapted to be opened outwards so that exhalation through a nostril may sufficiently increase a pressure within the mask 1 to drive a quantity of water accumulating inside the nose covering portion 50 out of the mask 1. While this variant of the mask 1 includes no member corresponding to the frame holding member 10 provided in the embodiment shown in FIG. 1 to protect the purge valves 40, 66, such member may be added to this variant, if desired. The second opening 18 and the purge valve 40 provided in each top 11A may be location-shifted to each lateral side lib of the outer peripheral frame 8** so far as such location-shift does not result in obstructing wearer's sight.

Figure 9:
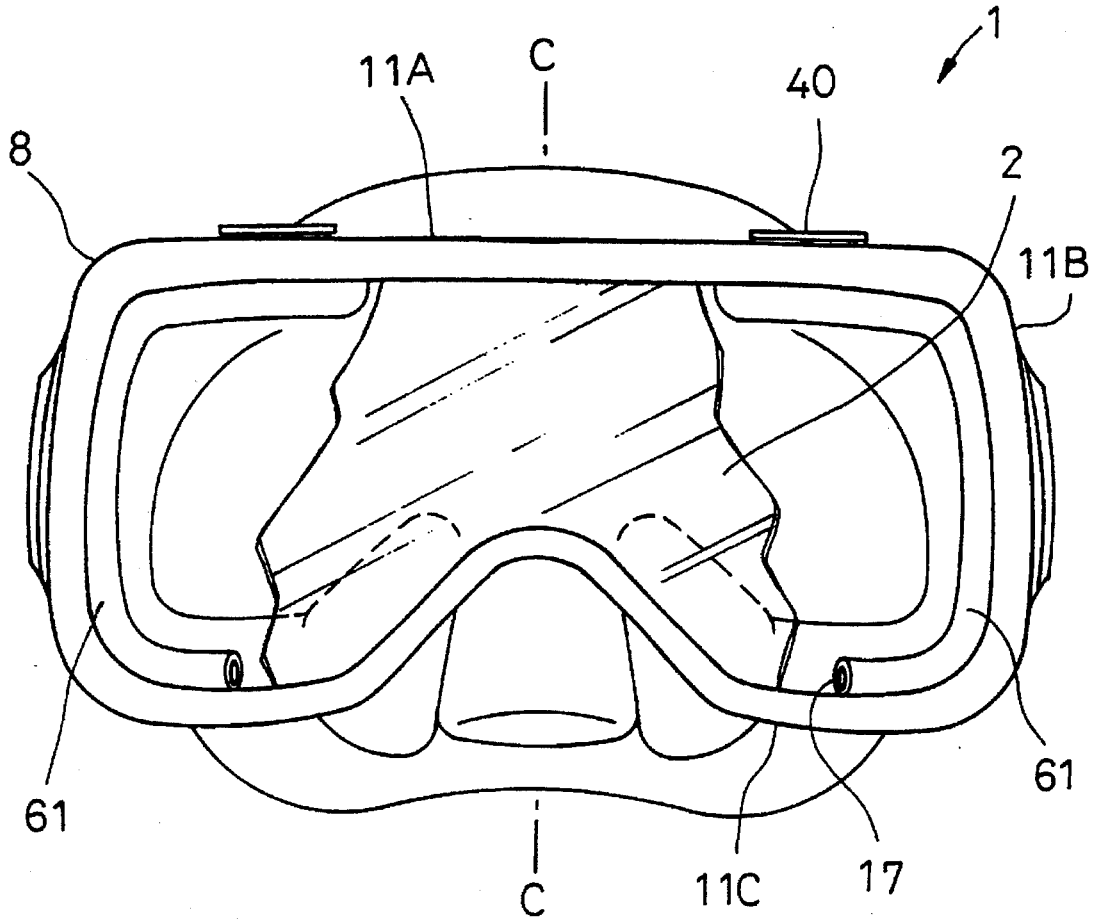
FIG. 9 is a front view showing another variant of the mask as partially broken away.

FIG. 9 is a front view showing another variant of the mask 1 as partially broken away. According to this variant, right and left eyes are covered by a single larger front lens 2 and the central connector portion 12 shown in FIG. 1 is not provided. There are provided a pair of water purge channels 61 extending along the inner peripheries of the outer peripheral frame 8 on either lateral sides 11B. An upper end of each water purge channel 61 serving as an outlet is in fluid-communication with right- or left- hand second opening 18 (not shown) extending through the top 11A of the outer peripheral frame 8 and each second opening 18 is provided with the purge valves 40 adapted to be opened outwards. Each first opening 17 serving as an inlet defined at the lower end of each water purge channel 61 is provided at the lowest positions 11C on the right or left side of the outer peripheral frame 8.

Figure 10:
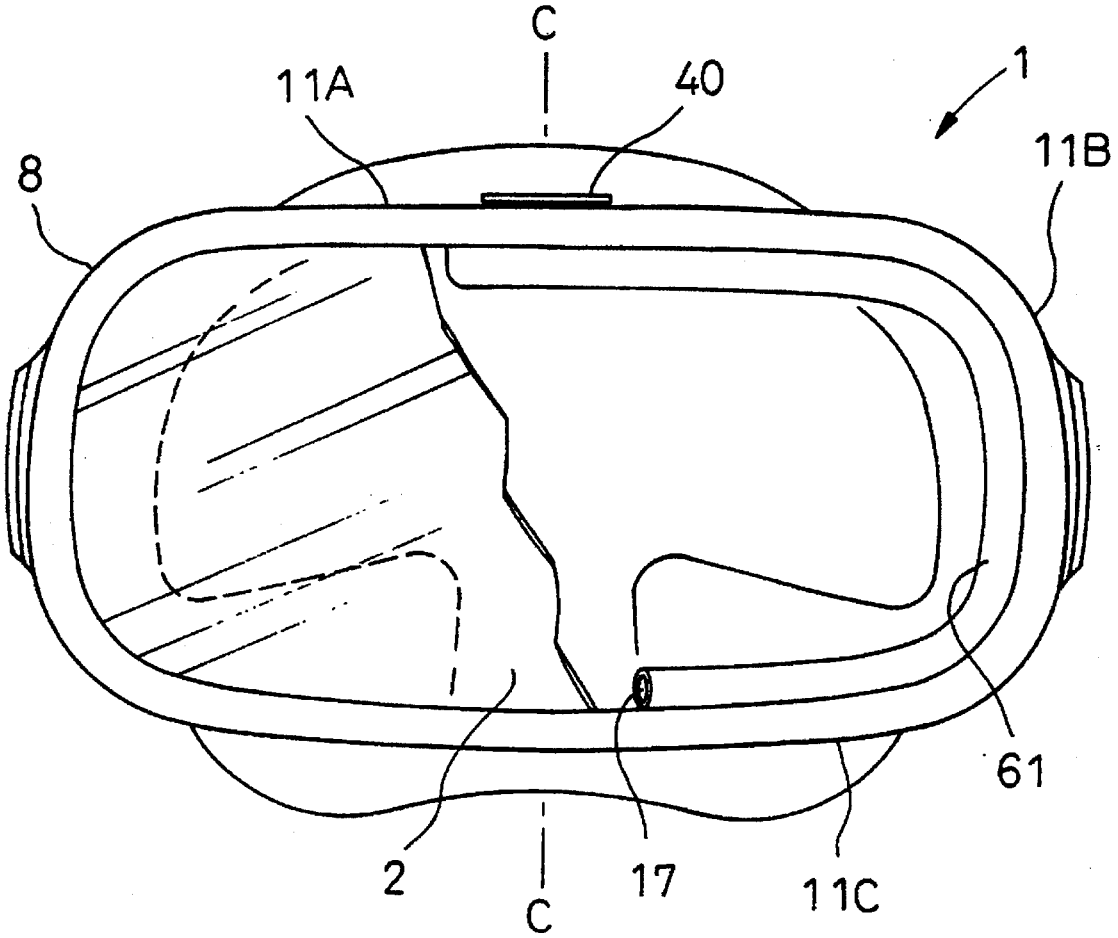
FIG. 10 is a front view showing still another variant of the mask.

FIG. 10 is a front view showing still another variant of the mask 1 as partially broken away. The mask 1 according to this variant is similar to the mask shown by FIG. 9 except that the lowest position 11C of the outer peripheral frame 8 is located on the center line C—C of the mask 1. The water purge channel 61 extends from the middle point on the top 11A along the inner periphery of right- or left-hand lateral side section 11B to a point on the position 11C of the outer peripheral frame 8 lying adjacent the center line C—C. The outlet of the water purge channel 61 is in fluid-communication with the second opening 18 (not shown) extending through the top 11A to the exterior of the mask 1, and the second opening 18 is provided with the purge valve 40 adapted to be opened outwards. The position 11C is provided with the first opening 17 serving as an inlet.

With the diving face mask according to the invention, a purge valve does not obstruct wearer's sight, since a purge valve for purging exhalation through a wearer's nostril as well as a quantity of water accumulating within the mask are provided at an appropriate location in a zone predetermined along a top side and outer side sections of an outer peripheral frame of the mask so as to be in fluid-communication with an outlet at an upper end of a water purge channel provided within a main frame of the mask and a lower end of the water purge channel provides an inlet for water accumulated at the bottom of the outer peripheral frame.

When it is desired to provide the mask with a pair of nose holding portions, those portions can be dimensioned to be large enough to assure a good holding operation because the mask has no purge valves at its bottom side.

According to the invention, it is possible to adopt a water purge mechanism also for a mask of two-lens type for which incorporation of such mechanism has conventionally been difficult.

What is claimed is:

1. A diving face mask comprising a main frame formed with a lens frame having a top, transversely opposite sides curving downwards respectively from transversely opposite ends of said top, a bottom being continuous with said opposite sides and opposed to said top, and a lens holding portion, and a tubular skirt extending rearwards from said lens holding portion; a front lens held by said lens holding portion; a strap connected to both sides of said main frame used to maintain the mask on a wearer's face; and a purge valve mounted on said main frame and adapted to be opened outwards; wherein said purge valve is provided at a predetermined location in a zone defined along said top of said lens frame, and a tubular water purge channel is provided along the inner periphery of said main frame inside said front lens, said tubular water purge channel having an outlet at one end being in fluid-communication with said purge valve and an inlet at the other end opening into the interior of said main frame at the bottom of said main frame.

2. The mask according to claim 1, wherein said mask further comprises a pair of lenses and a nose covering portion interposed between said lenses.

3. The mask according to claim 2, wherein said valve is provided at a transversely middle point along said top and there is provided said water purge channel in association with each of said lenses in fluid-communication with said valve.

4. The mask according to claim 3, wherein there is provided inside said nose covering portion a vertically extending tubular purge channel with an outlet at its upper end being in fluid-communication with said valve from the inside and an inlet at its lower end opening into the interior of said mask at the bottom of said nose covering portion.

5. The mask according to claim 2, wherein said valve and water purge channel are provided in association with each of said lenses, and said valve and water purge channel are in fluid-communication with each other for each of said lenses.

6. The mask according to claim 5, wherein there is provided at a transversely middle point along said top a purge valve adapted to be opened outwards and there is provided a vertically extending tubular water purge channel with an outlet at its upper end being in fluid-communication with said valve from the inside and an inlet at its lower end opening into the interior of said mask at the bottom of said nose covering portion.

7. The mask according to claim 1, wherein said mask comprises a single front lens.

8. The mask according to claim 7, wherein said valve is provided at a transversely middle point along said top and said water purge channel is provided along one of transversely opposite sides of said single lens, with an outlet at its upper end being in fluid-communication with said valve from the inside of said main frame and an inlet at its lower end opening into the interior of said mask at a middle point along the bottom of said main frame.

9. The mask according to claim 7, wherein said valve is provided in said top at a location adjacent each of transversely opposite ends thereof and said water purge channel is provided along each of transversely opposite sides of said single lens with an outlet at its upper end being in fluid-communication with said valve provided on the same side as said outlet and an inlet at its lower end being open into the interior of said mask on the same side as said valve at the bottom of said main frame.

* * * * *